US008857856B2

(12) United States Patent
Mayrhofer

(10) Patent No.: US 8,857,856 B2
(45) Date of Patent: Oct. 14, 2014

(54) SECURITY FOIL OR SECURITY LABEL COMPRISING A MANIPULATION DETECTION SYSTEM

(75) Inventor: Marco Mayrhofer, Sierning (AT)

(73) Assignee: Hueck Folien Ges.m.b.H., Baumgartenberg (AT)

( * ) Notice: Subject to any disclaimer, the term of this patent is extended or adjusted under 35 U.S.C. 154(b) by 48 days.

(21) Appl. No.: 13/139,596

(22) PCT Filed: Mar. 5, 2010

(86) PCT No.: PCT/EP2010/001373

§ 371 (c)(1),
(2), (4) Date: Aug. 4, 2011

(87) PCT Pub. No.: WO2010/102755

PCT Pub. Date: Sep. 16, 2010

(65) Prior Publication Data

US 2011/0291399 A1 Dec. 1, 2011

(30) Foreign Application Priority Data

Mar. 9, 2009 (AT) ..... A 373/2009

(51) Int. Cl.
*B42D 15/00* (2006.01)

(52) U.S. Cl.
CPC ..... *B42D 15/0013* (2013.01); *B42D 2033/24* (2013.01); *B42D 2035/22* (2013.01); *B42D 2031/28* (2013.01); *B42D 2033/10* (2013.01)
USPC ..... 283/98; 283/81; 283/86; 283/91; 283/101; 283/108

(58) Field of Classification Search
USPC ..... 283/81, 86, 101, 91, 98, 108; 428/915–916; 359/2
See application file for complete search history.

(56) References Cited

U.S. PATENT DOCUMENTS 6,087,075 A * 7/2000 Kler et al. ..... 283/101
6,697,179 B2 * 2/2004 Hsiao ..... 359/2

(Continued)

FOREIGN PATENT DOCUMENTS

| | | |
|---|---|---|
| DE | 10 2006 055 680 | 5/2008 |
| DE | 10 2007 019 522 | 10/2008 |
| EP | 1 798 054 | 6/2007 |
| EP | 2 164 032 | 3/2010 |

OTHER PUBLICATIONS

International Search Report issued Jun. 9, 2010 in International (PCT) Application No. PCT/EP2010/001373.

*Primary Examiner* — Shelley Self
*Assistant Examiner* — Justin V Lewis
(74) *Attorney, Agent, or Firm* — Wenderoth, Lind & Ponack, L.L.P.

(57) ABSTRACT

A security foil includes two or more carrier substrates which have at least one optically active structure and at least two metal layers. The security foil is composed as follows: a) a first carrier substrate, b) a first radiation-curable lacquer layer into which an optically active structure is incorporated, c) a first metal layer, d) a protective lacquer layer, e) an adhesive layer, f) a second carrier substrate, g) a second radiation-curable lacquer layer, h) a second metal layer, i) optionally a protective lacquer layer, and k) optionally an adhesive coating. The adhesion between the layers g) and h) or f) and g) is significantly lower than the adhesion between the remaining layers.

17 Claims, 2 Drawing Sheets

(56) References Cited

U.S. PATENT DOCUMENTS 7,808,605 B2 * 10/2010 Hoffmuller et al. ..... 283/91
8,052,171 B2 * 11/2011 Staub et al. ..... 283/91
2001/0005570 A1 * 6/2001 Daniel et al. ..... 283/86
2005/0104364 A1 * 5/2005 Keller et al. ..... 283/72
2008/0224462 A1 * 9/2008 Dubner et al. ..... 283/72

* cited by examiner

SECURITY FOIL OR SECURITY LABEL COMPRISING A MANIPULATION DETECTION SYSTEM

BACKGROUND OF THE INVENTION (1) Field of the Invention

The invention relates to a security foil which can be applied to a valuable document or to a data storage medium and permits manipulation to be detected.

(2) Description of Related Art

Security labels or security foils are known and generally have a manipulation detection layer, which means a layer having different adhesive regions, and an adhesive coating and additionally one or more security features. Particularly suitable security features are, for example, luminescent security features, which can generally be produced cost-effectively but provide relatively good protection against imitation.

DESCRIPTION OF THE INVENTION

Figure 1A:
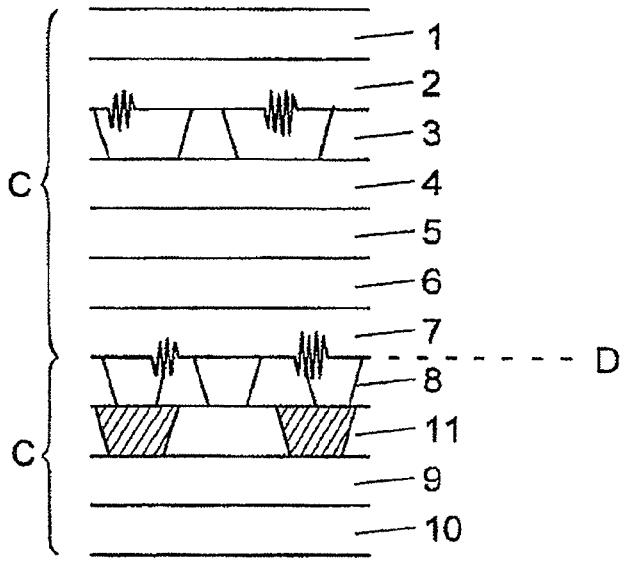
FIGS. 1A, 1B, and 1C show a security foil according to a first embodiment of the invention.

The object of the invention is to provide a security foil which can be applied to an object to be secured, for example a valuable document, a data storage medium, a package or the like.

The subject of the invention is therefore a security foil comprising two or more carrier substrates which have at least one optically active structure and at least two metallic layers, characterized in that the security foil is built up as follows:

a) a first carrier substrate
b) a first radiation-curable lacquer layer, into which an optically active structure is introduced
c) a first metallic layer
d) if appropriate, a protective lacquer layer
e) an adhesive layer
f) a second carrier substrate
g) a second radiation-curable lacquer layer
h) a second metallic layer
i) if appropriate, a protective lacquer layer
k) if appropriate, an adhesive coating, wherein the adhesion between the layers g) and h) or f) and g) is significantly lower than the adhesion between the remaining layers.

Suitable carrier substrates a) are, for example, carrier foils, preferably flexible plastic films, for example made of PI, PP, MOPP, PE, PPS, PEEK, PEK, PEI, PSU, PAEK, LCP, PEN, PBT, PET, PA, PC, COC, POM, ABS, PVC, fluoropolymers such as Teflon and the like. The carrier foils preferably have a thickness from 5-700 μm, preferably 5-200 μm, particularly preferably 5-100 μm.

Here, optically active structure is understood to mean in particular optically diffractive active structures, such as holograms, surface reliefs, diffractive structures, diffraction gratings, kinegrams and the like.

A radiation-curable lacquer layer b) is applied to the first carrier substrate.

The radiation-curable lacquer can be, for example, a radiation-curable lacquer system based on a polyester, an epoxy or polyurethane system which contains two or more different photo-initiators familiar to those skilled in the art, which are able to initiate curing of the lacquer system to a different extent at different wavelengths. For instance, a photo-initiator can be activated at a wavelength of 200 to 400 nm, the second photo-initiator can then be activated at a wavelength of 370 to 600 nm. A sufficient difference should be maintained between the activation wavelengths of the two photo-initiators that excessively high excitation of the second photo-initiator does not take place while the first photoinitiator is being activated. The range in which the second photo-initiator is excited should lie in the transmission wavelength range of the carrier substrate used.

For the main curing (activation of the second photo-initiator), electron radiation can also be used.

The radiation-curable lacquer used can also be a water-dilutable lacquer. Lacquer systems based on polyesters are preferred.

The replication of the surface structure, i.e. the diffraction or relief structure into the radiation-curable lacquer layer, is carried out for example at a controlled temperature by means of a die or by using an embossing mold, said lacquer layer having been pre-cured as far as the gel point by activating the first photo-initiator and being at this stage at the time of the replication.

If use is made of a water-dilutable radiation-curable lacquer, pre-drying, for example by means of IR radiators, can be connected upstream if appropriate.

The layer thickness of the radiation-curable lacquer applied can vary, depending on the requirement on the end product and the thickness of the substrate and is generally between 0.5 and 50 μm, preferably between 2 and 10 μm, particularly preferably between 2 and 5 μm.

A full-area or preferably partial metallic layer c) is subsequently applied to the optically active structure produced in this way.

To this end, preferably in a first step, a color coating soluble in a solvent is applied, in a second step, this layer is treated by means of an in-line, plasma, corona or flame process and, in a third step, a layer of metals, metal compounds, alloys is applied, whereupon, in a fourth step, the color coating is removed by means of a solvent, if appropriate combined with mechanical action.

The color coating used or lacquer coating used is soluble in a solvent, preferably in water, but it is also possible for a color coating soluble in any desired solvent, for example in alcohol, esters and the like, to be used. The color coating or lacquer coating can be conventional formulations based on natural or artificial macromolecules. The soluble color coating can be pigmented or non-pigmented. It is possible to use all known pigments as the pigment. Particularly suitable are $TiO_2$, ZnS, kaolin and the like.

The printed carrier substrate is then treated by means of an in-line, plasma (low-pressure or atmospheric plasma), corona or flame process if appropriate in order to improve the adhesion of the layer subsequently applied. By means of a high-energy plasma, for example an Ar or $Ar/O_2$ plasma, the surface is cleaned of toning residues of the printing inks. At the same time, the surface is activated. In the process, terminal polar groups are produced on the surface. As a result, the adhesion of metals and the like to the surface is improved.

If necessary, at the same time as the application of the plasma, corona or flame treatment, a thin metal or metal oxide layer can be applied as an adhesion promoter, for example by means of sputtering or vapor deposition. Particularly suitable here are Cr, AI, Ag, Ti, Cu, $TiO_2$, Si oxides or chromium oxides. This adhesion promoter layer generally has a thickness of 0.1 nm-5 nm, preferably 0.2 nm-2 nm, particularly preferably 0.2 to 1 nm.

As a result, the necessary excellent adhesion between the two layers b) and c) is achieved.

A partial metallic layer c) can be applied in the same way as the second metallic layer h) in the form of letters, numbers, symbols, lines, guilloches, logos and the like. Furthermore, these letters, numbers, symbols, lines, guilloches, logos and the like can be defined by cutouts in the metallic layer.

Suitable metallic layers are, for example, layers of Al, Cu, Au, Ag, Pd, Pt, Ni, Zn, Sn and the like. Furthermore, alloys or metallic oxides such as copper oxides, Ti02, SiOx are suitable as metallic layers.

The structure is then provided with a protective lacquer layer, if appropriate, and, by using a laminating adhesive layer, is joined to a further carrier substrate f), which likewise has a radiation-curable lacquer layer g).

In order to achieve a high degree of adhesion between this second carrier substrate f) and the second radiation-curable lacquer layer g), an acrylate-coated plastic film or a foil provided with an adhesion promoter is preferably used, so that the adhesion of the radiation-curable lacquer to the foil is considerably better than to the metallization.

If the lowest adhesion in the structure is to be established between the layers f) and g), then the materials listed for the carrier substrate a) are suitable for the carrier substrate f).

This second radiation-curable lacquer layer can have a further optically active structure.

If appropriate, the radiation-curable lacquer layer can be provided with a further coating, for example a partial opaque coating, which has cutouts in the form of characters, letters, patterns, symbols, lines, guilloches and the like.

A further partial metallic layer h) is then applied to this layer, but during the production of the layer the above-described steps of pre-treatment and of application of an adhesion promoter not being carried out if the lowest adhesion in the structure is to be present between the layers g) and h).

As a result, weaker adhesion of the metallic layer to the layer lying underneath is achieved; here, a weakening is produced in the composite, which is known as an intended fracture point.

The function of the security element is based on two metallizations which are superimposed in such a way that only the upper metallization (having the first optically active structure) is visible and only after manipulation does the second metallization (possibly having a further optically active structure) appear.

Partial metallic layers c) and g) are preferably congruent but can also be arranged partially overlapping in relation to one other or partly complementing one other, so that before the manipulation the impression of a continuous metallization is produced. The layers can be congruent with the optically active structure(s) or else can be arranged partially overlapping.

The structure can then be provided with a protective lacquer layer and/or an adhesive coating for application to a substrate.

The adhesive coating can be a self-adhesive coating, a cold-seal or hot-seal coating.

Figure 1B:
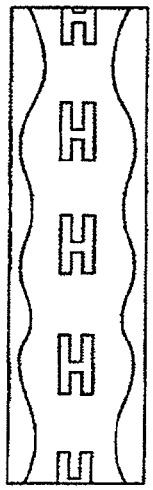
Figure 1C:
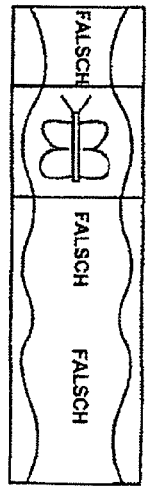

In one embodiment (FIG. 1), the two metalized regions are identical and superimposed in exact register. Furthermore, between the first and second metallization there is hidden embossing, which becomes visible only after manipulation. On the substrate, the lower metallization having the hologram "FALSE" (German "FALSCH") is left behind. The first hologram is pulled off.

Figure 2A:
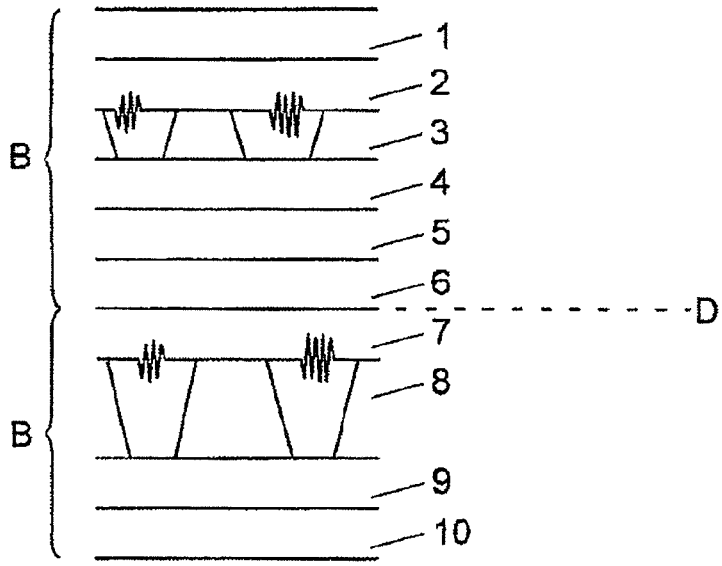
FIGS. 2A, 2B, and 2C show a security foil according to a second embodiment of the invention.
Figure 2B:
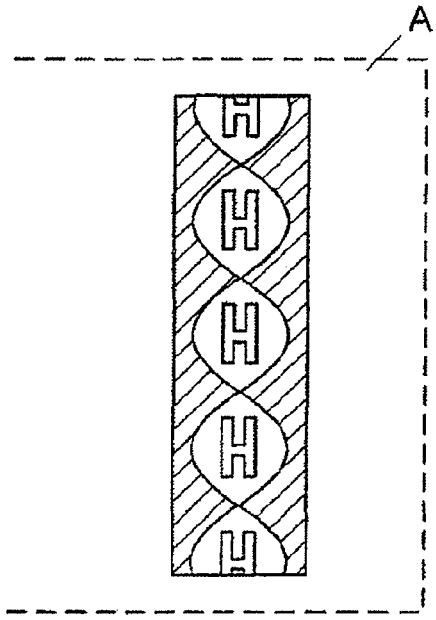
Figure 2C:
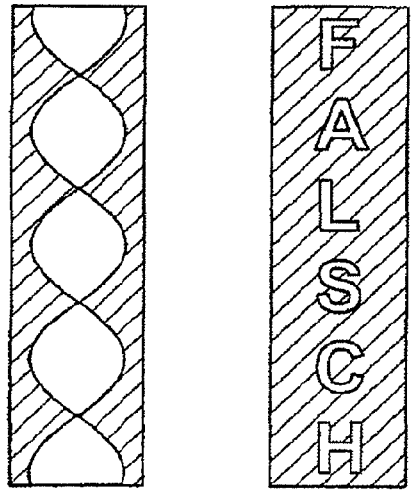

In a further embodiment (FIG. 2), a further partial layer (e.g. in the form of letters or defining the letters as cutouts) is hidden under the first partial metallic layer c) (including embossing) and becomes visible only when manipulation is carried out. After the layer has been pulled off, metalized letters "FALSE" are left behind on the substrate. The main hologram is pulled off.

If optically active structures are introduced into the layers b) and g), respectively, then these can be introduced in accurate register with one another or at least partly overlapping.

The optically active structure can, if appropriate, contain additional information, so that proof of authenticity is also possible after the manipulation. The additional information introduced can be, for example, product codes, batch numbers and the like.

Furthermore, the security foil according to the invention can have further security features, such as electrically conductive layers, layers with magnetic or optical features (for example luminescent features, thermochromic features, pearlescent layers and the like).

In the figures, reference character A means the data storage medium or the package to be secured, reference characters B and C indicate the alternative regions of high adhesion, and reference character D indicates the intended fracture point. Reference number 1 denotes a first carrier substrate, reference number 2 denotes a first radiation-curable lacquer layer into which an optically active structure is introduced, reference number 3 denotes a first (partial) metallic layer, reference number 4 denotes a protective lacquer layer, reference number 5 denotes an adhesive layer, reference number 6 denotes a second carrier substrate, reference number 7 denotes a second radiation-curable lacquer layer, reference number 8 denotes a second (partial) metallic layer, reference number 9 denotes a protective lacquer layer, reference number 10 denotes an adhesive coating, and reference number 11 denotes a partial opaque layer.

The security foil according to the invention can be used as a security element on data storage media or packages, as a security label for securing objects or packages or as a vignette.

The invention claimed is:

1. A security foil comprising:

a) a first carrier substrate;

b) a first radiation-curable lacquer layer into which an optically active structure is introduced, the first radiation-curable lacquer layer being disposed on the first carrier substrate, and the first radiation-curable lacquer layer containing two or more different photo-initiators and being a water-dilutable lacquer or being based on a polyester, an epoxy or polyurethane system;

c) a first metallic layer disposed on the first radiation curable lacquer layer;

d) a first protective lacquer layer disposed on the first metallic layer;

e) an adhesive layer disposed on the first protective lacquer layer;

f) a second carrier substrate disposed on the adhesive layer;

g) a second radiation-curable lacquer layer disposed on the second carrier substrate;

h) a second metallic layer disposed on the second radiation-curable lacquer layer;

i) a second protective lacquer layer disposed on the second metallic layer; and j) an adhesive coating disposed on the second protective lacquer layer, wherein one of the following conditions is satisfied:

(i) adhesion between the layers g) and h) is significantly lower than adhesion between the remaining layers, and the second carrier substrate f) is an acrylate-coated plastic film or a foil provided with an adhesion promoter; and (ii) adhesion between the layers f) and g) is significantly lower than adhesion between the remaining layers, and the second carrier substrate f) is a plastic film made of PI, PP, MOPP, PE, PPS, PEEK, PEK, PEI, PSU, PAEK, LCP, PEN, PBT, PET, PA, PC, COC, POM, ABS, PVC, or fluoropolymers, and wherein the first metallic layer and the second metallic layer are superimposed in such a way that the second metallic layer is visible only after the first metallic layer is separated from the second metallic layer.

2. The security foil of claim 1, wherein the second radiation-curable lacquer layer has an optically active structure.

3. The security foil of claim 2, wherein the optically active structure is a hologram, a surface relief, a diffractive structure, a diffraction grating or a kinegram.

4. The security foil of claim 3, wherein a partial opaque layer is present between layer g) and h).

5. The security foil of claim 1, wherein layers c) and h) are partial layers and are arranged at least partially overlapping in relation to one another and/or in relation to the optically active structure.

6. The security foil of claim 2, wherein layers c) and h) are partial layers and are arranged at least partially overlapping in relation to one another and/or in relation to the optically active structure.

7. The security foil of claim 6, wherein the optically active structures of the first radiation-curable lacquer layer and the second radiation-curable lacquer layer are at least partly overlapping.

8. The security foil of claim 6, wherein the optically active structures of the first radiation-curable lacquer layer and the second radiation-curable lacquer layer are precisely overlapping.

9. The security foil of claim 8, wherein the security foil has additional layers with electrically conductive, magnetic or optical features.

10. The security foil of claim 1, wherein the optically active structure is a hologram, a surface relief, a diffractive structure, a diffraction grating or a kinegram.

11. The security foil of claim 1, wherein a partial opaque layer is disposed between layer g) and layer h).

12. The security foil of claim 1, wherein layers c) and h) are partial layers and are arranged at least partially overlapping in relation to one another and/or in relation to the optically active structure.

13. The security foil of claim 1, wherein the security foil has additional layers with electrically conductive, magnetic or optical features.

14. The security foil of claim 1, wherein the two or more different photo-initiators include a first photo-initiator which is activated at a wavelength of 200 to 400 nm and a second photo-initiator which is activated as a wavelength of 370 to 600 nm.

15. The security foil of claim 1, wherein adhesion between the layers g) and h) is significantly lower than adhesion between the remaining layers, and the second carrier substrate f) is an acrylate-coated plastic film or a foil provided with an adhesion promoter.

16. The security foil of claim 1, wherein adhesion between the layers f) and g) is significantly lower than adhesion between the remaining layers, and the second carrier substrate f) is a plastic film made of PI, PP, MOPP, PE, PPS, PEEK, PEK, PEI, PSU, PAEK, LCP, PEN, PBT, PET, PA, PC, COC, POM, ABS, PVC, or fluoropolymers.

17. The security foil of claim 1, further comprising embossing between the first metallic layer and the second metallic layer, the embossing being hidden behind the first metallic layer and becoming visible only after the first metallic layer is separated from the second metallic layer.

* * * * *